US005651711A

United States Patent [19]

Samano

[11] Patent Number: 5,651,711

[45] Date of Patent: Jul. 29, 1997

[54] FLAG VEST

[76] Inventor: Bassam Samano, 5907 W. Emerson, Motor Grove, Ill. 60053

[21] Appl. No.: 621,664

[22] Filed: Mar. 26, 1996

[51] Int. Cl.[6] ..... B63C 9/08

[52] U.S. Cl. ..... 441/89; 116/173

[58] Field of Search ..... 441/89, 11; 116/173, 116/174

[56] References Cited

U.S. PATENT DOCUMENTS

| | | | |
|---|---|---|---|
| 3,213,823 | 10/1965 | Levy et al. | 116/173 |
| 4,035,856 | 7/1977 | Oberg | 441/89 |
| 4,598,661 | 7/1986 | Roe | 116/209 |
| 4,752,264 | 6/1988 | Melendez et al. | 441/89 |
| 5,114,369 | 5/1992 | Coffey | 411/11 |
| 5,423,282 | 6/1995 | Krull et al. | 116/209 |

*Primary Examiner*—Jesus D. Sotelo

*Attorney, Agent, or Firm*—Patent & Trademark Services; Joseph H. McGlynn

[57] ABSTRACT

A flotation vest which has a flexible, resilient mast attached thereto. The mast has a brightly colored signal flag secured to the uppermost portion of the mast. The mast is securely fastened at one end to the vest, and is bent over a wearer's shoulder and the other end is detachably secured within easy reach of the wearer. In this position the mast and attached flag are out of the user's way while they are engaged in water sport activities, however, the mast and flag can be easily and quickly deployed if a mishap occurs and the wearer is thrown into the water.

5 Claims, 1 Drawing Sheet

FLAG VEST

BACKGROUND OF THE INVENTION

This invention relates, in general, to a signal device to indicate the location of a person in the water, and, in particular, to a life saving vest to be worn by a person while engaged in water activities which has a signal flag attached thereto which will increase the visibility of a person in the water.

DESCRIPTION OF THE PRIOR ART

Today water sport activities, such as sailing, water skiing and powered jet skiing are becoming more popular. In all of these activities it is imperative that participants wear safety devices such as flotation vests. These vest are designed to support a person while in the water even if the person is injured or unconscious.

While manning a sail boat it is not uncommon for people to be thrown over board. They will then have to wait until the boat is turned around and returns for them. Since it takes a considerable amount of time for a sail boat to return in such a case, the person in the water may be lost from sight and hard to find. In such cases it would make rescue much easier if the person in the water had a signal flag which would be raised high above the person's head to make sighting him/her easier.

In the case of water skiing or riding powered jet boats, frequently users of these devices lose their balance or suffer some other mishap which results in the user falling into the water and being separated from the water skies or jet skies. Because the sports of water skiing or jet skiing are frequently undertaken in water ways used by power boats or other water crafts, including high speed power boats, the participants in water skiing or jet skiing are subject to hazards which arise during the time they spend floating in the water. While water skiers and jet skiers are highly visible while traveling across the water surface, after they fall into the water, they are difficult to see and experience difficulty in moving out of the way of fast moving water craft. As a result, water skiers and jet skiers floating in the water are subject to substantial risk of being struck by speeding power boats.

In such cases it would be much safer if the person in the water had a signal flag which would be raised high above the person's head to make sighting him/her easier by power boats or other water crafts.

In the prior art various types of life saving devices have been proposed. For example, U.S. Pat. No. 4,598,661 discloses a signal device attached to a flotation vest which includes a telescoping flag member which can be extended to increase the wearer's visibility in the water.

U.S. Pat. No. 4,752,264 discloses a flexible mast attached to a flotation vest and which carries a flag. The flexible mast extends upwardly from the life jacket for a substantial distance beyond the highest point of the wearer's head and terminates in a high visibility flag at its upper end.

U.S. Pat. No. 5,114,369 discloses a signal flag which can be attached to a person's arm while engaged in water activities. The device includes Velcro hook and loop fasteners to secure the device to a person, a flag pole which can be extended, a high visibility flag and a weighted flotation device which maintains the signal displayed above the water when the pole is unattended.

U.S. Pat. No. 5,423,282 discloses a signal device worn by a person while engaged in a water activity. The signal device includes at least one belt that may be secured to a variety of flotation devices or it may be secured directly about a person's torso. A mast and a signal flag secured thereto are attached to the belt.

Although there are many different types of signal devices specifically designed to be worn by persons engaged in water sports, none of the prior art devices are convenient to wear and easy to use. For example the U.S. Pat. Nos. 4,598,661 and 5,114,369 devises must be pulled out of their telescoped position to be easily seen. If worn by a person who accidentally falls overboard, this may be beyond their ability while in the water of if they are hurt or unconscious. The U.S. Pat. Nos. 4,752,264 and 5,423,282 devices must be worn fully extended at all times. Wearing a flotation vest with an antenna fully extended while engaged in various activities, for example sailing a boat, can be unduly restrictive and even dangerous. The fully extended mast on the flag can become entangled in the various lines attached to sail on sail boats creating a hazardous situation.

What is needed is a signal device which can be stored so it is not in an extended position while the wearer is engaged in water activities, and yet can be extended to a operating position quickly and easily if the wearer falls into the water. The device should be capable of being operated by a person who has been injured while falling overboard from a boat or off water skies.

SUMMARY OF THE INVENTION

The present invention comprises a flotation vest which has a flexible mast attached thereto. The mast has a brightly colored signal flag secured to the uppermost portion of the mast. The mast is securely fastened at one end to the vest, and is bent over a wearer's shoulder and the other end is detachably secured within easy reach of the wearer. In this position the mast and attached flag are out of the user's way while they are engaged in water sport activities, however, the mast and flag can be easily and quickly deployed if a mishap occurs and the wearer is thrown into the water.

It is an object of the present invention to provide an improvement in the safety devices worn by persons engaged in water sport activities.

It is an object of the present invention to provide an improved device to increase the visibility of persons engaged in water sport activities.

It is an object of the present invention to provide an improved water safety device which will not interfere with normal water sport activities, but is easily and quickly deployed if needed in an emergency.

These and other objects and advantages of the present invention will be fully apparent from the following description, when taken in connection with the annexed drawings.

DESCRIPTION OF THE PREFERRED EMBODIMENT

Figure 1:
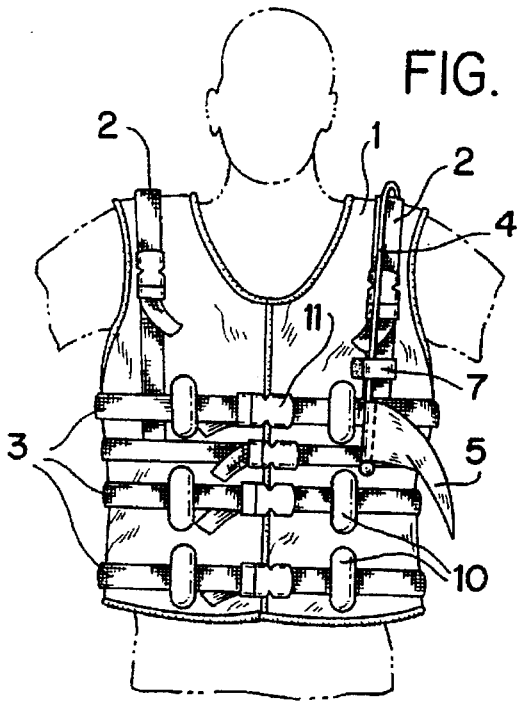
FIG. 1 is a view showing the front of the flotation vest of the present invention.

Referring now to the drawings in greater detail, FIG. 1 shows the flotation vest 1 of the present invention from the front as worn by a person engaged in water sport activities. The vest is a commercially available unit usually consisting of a body portion fabricated from duck cloth or a similar material. The vest has shoulder harness straps 2 made of nylon webbing and several horizontal body straps 3 also made from nylon webbing and secured by clamps 11 to secure the vest 1 about the torso of a person. The straps can be equipped with adjustment buckles 10 so the vest can be adjusted to fit people of different sizes. It should be noted that the specific vest shown is merely fro illustration purposes, and any style of flotation vest could be used with the present invention.

Figure 2:
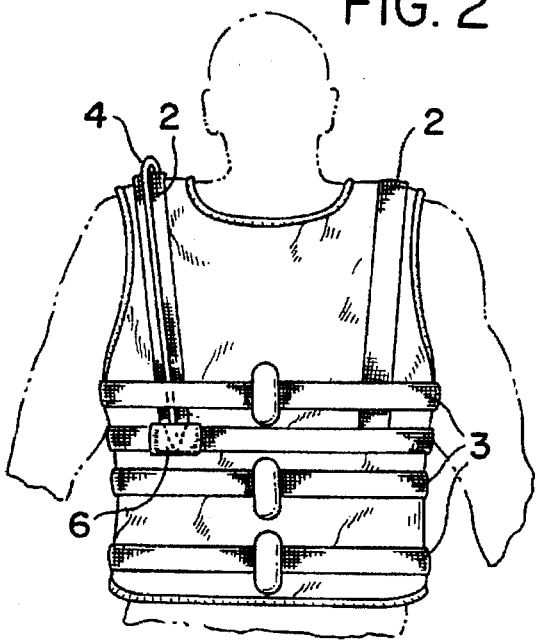
FIG. 2 is a view showing the back of the flotation vest of the present invention.
Figure 3:
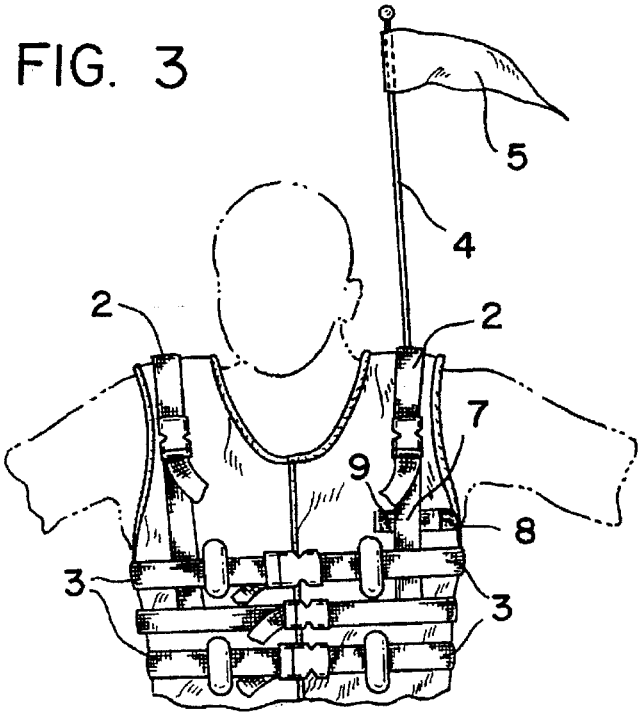
FIG. 3 is a view showing a person wearing the flotation vest of the present invention with the signal flag deployed.

Secured behind one of the shoulder straps 2, as shown in FIG. 2, is a flexible pole 4 which is made of a material such as, but not limited to, fiberglass. Fiberglass is the preferred material since it is flexible enough to be bent in the manner shown in FIGS. 1 and 2, yet strong enough to withstand many years of use being moved from a bent position to a deployed position as shown in FIG. 3.

The pole 4 is secured to the back of the flotation vest 1 onto an anchor point 6 at the intersection of a shoulder strap 2 and a torso strap 3. The anchor point 6 is manufactured of injection molded ABS plastic, however, other materials and methods of forming the anchor point can be used. The anchor point 6 can be secured to the vest and to the pole using any conventional means such as, but not limited to, molding the anchor point about the straps 2 or 3, and the pole or by waterproof glue.

The pole anchor point 6 is preferably manufactured using a plastic injection molding process. Injection molding is a plastic molding procedure whereby heat softened plastic material is forced under very high pressure into a metal cavity mold which is relatively cool. Acceptable metals for the mold are aluminum and steel. The inside cavity of the mold is comprised of two or more halves, and is the same desired shape as the product to be formed. High pressure hydraulics are used to keep the mold components together during the actual injection phase of the molding process. The injected plastic is allowed to cool and harden. The hydraulics holding the multiple component cavity together are released, the halves of the mold are separated and the solid formed plastic item is removed. Injection molding can be a highly automated process and is capable of producing extremely detailed parts at a very cost effective price.

The pole can be manufactured using fiberglass epoxy, with elongated glass strands being used as reinforcement. Fiberglassing of this type involves three components; the epoxy, the hardener for the epoxy, and the fiberglass strands. The pole 4 is fabricated with these materials by either casting the components together to form a pole or by the extrusion method.

The plastic extrusion process is one whereby molted, heat softened plastic is forced under high pressure through a die, similar to toothpaste being squeezed through the hole in the top of the tube, (in this example the hole in the tube is the die). The plastic forms a continuous length in the shape of the die it was squeezed through. In other words, the plastic would come out continually in the shape of the rod using the nozzle as a die. The nozzle could be any shape desired, (square, circular, triangular, etc.). Again, the above mentioned manufacturing processes are merely for illustration purposes, and other methods may be employed without departing from the scope of the invention.

As shown in FIGS. 1 and 3, attached to the top of the pole 4 is a flag 5. The flag 5 should be a bright color that can be easily seen from a distance. The flag is preferably manufactured using an electronically heat welded vinyl process. Vinyl may be die cut and heat welded together. The "die cutting" of the sheet vinyl is a process which cuts vinyl into a specific shape through the use of steel ruled dies. Steel ruled dies are flat, sharpened pieces of steel which resemble a hacksaw blade. The dies are bent into the desired shape and held in place by channels cut out into a thick sheet of wood. In operation, the sharpened edges of the die are brought into face to face contact with a flat piece of vinyl. The die is pressed against the vinyl sheet, cutting it to the shape of the flag 5. Nylon cloth could also be used for the material of the flag, which would be cut and sewn into the shape of the flag and attached by the same method as the vinyl. Of course other materials and methods could be used to make and attach the flag 5 to the pole 4 without departing from the scope of the present invention.

In use, a person could wear a flotation vest with the flag attached, or the flag could be attached to a vest which is worn over the standard life jacket or vest. In either case the straps 2 and 3 would be adjusted to fit the individual, and the buckles 11 attached to securely fasten the device. The pole would be bent over a person's shoulder (either the right or left shoulder) and secured to the front of the vest by a strap 7 which has anchor point 6 Velcro hook and loop fasteners 8 attached thereto. Mating Velcro hook and loop fasteners 9 would be attached to the shoulder strap 2. The pole would be placed under the strap 7 which would then be secured by the Velcro hook and loop fasteners 8 and 9. A user could then carry on normal activities without the pole or flag interfering.

If the user falls into the water, he/she merely has to reach up and pull the strap 7 which will release the pole 4. The natural resiliency of the pole will raise the flag 5 above the wearer's shoulder, and the bright color and high position of the flag would insure the user would be very visible to other water skiers, boaters, swimmers, etc.

Although the flag vest and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A signal device adapted to be worn by a person engaging in water sport activities, said device comprising:

a garment worn about the torso of said person, means for securely attaching said garment to said person, a resilient pole, one end of said pole being permanently secured said garment, said pole being bent over a shoulder of said person and another end being detachably secured to a front portion of said garment by detachable securing means, a flag being attached to said another end, said detachable securing means is a strap which has a hook and loop fastener on one end, a mating hook and loop fastener is attached to a portion of said garment, and said pole is adapted to be placed under said strap which is then secured by said hook and loop fasteners, whereby if said person is thrown into the water, said person may release said detachable securing means and said pole will be automatically raised above said person to make said person visible to other people.

2. The signal device as claimed in claim 1, wherein said pole is made from fiberglass.

3. The signal device as claimed in claim 1, wherein said flag is made from vinyl.

4. The signal device as claimed in claim 1, wherein said garment is a flotation device.

5. The signal device as claimed in claim 1, wherein said garment is a vest adapted to be worn over a flotation device.

* * * * *